US006497552B2

(12) United States Patent
Kobayashi et al.

(10) Patent No.: US 6,497,552 B2
(45) Date of Patent: Dec. 24, 2002

(54) FUEL PUMP FOR INTERNAL COMBUSTION ENGINE

(75) Inventors: Atsushige Kobayashi, Nagoya (JP); Kiyotoshi Oi, Anjo (JP); Hiroaki Takei, Kariya (JP); Yoshio Ebihara, Kariya (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/835,062

(22) Filed: Apr. 16, 2001

(65) Prior Publication Data

US 2001/0036400 A1 Nov. 1, 2001

(30) Foreign Application Priority Data

Apr. 14, 2000 (JP) ..... 2000-113696

(51) Int. Cl.[7] ..... F04D 5/00
(52) U.S. Cl. ..... 415/55.1; 415/55.2
(58) Field of Search ..... 415/55.1, 55.2

(56) References Cited

U.S. PATENT DOCUMENTS 5,407,318 A 4/1995 Ito et al. ..... 415/55.1

FOREIGN PATENT DOCUMENTS

JP 6-159282 6/1994

*Primary Examiner*—Edward K. Look
*Assistant Examiner*—Kimya N McCoy
(74) *Attorney, Agent, or Firm*—Nixon & Vanderhye PC

(57) ABSTRACT

An impeller has a plurality of blades at an outer periphery thereof. Each of the adjacent blades define a groove space, and a partition wall is provided in the groove space. The partition wall is disposed at a center area of the groove space in an axial direction of the impeller for partitioning the groove space from a root of the blade. The blade inclines backwardly in the rotating direction at the root side thereof, and inclines frontwardly in the rotating direction at a radial outer end side thereof. A front face is inwardly concaved from both axial ends, and warps from the root to the radial outer end of the blade to form the concave such that the concave gradually becomes small from the root to the radial outer end.

20 Claims, 7 Drawing Sheets

FUEL PUMP FOR INTERNAL COMBUSTION ENGINE

CROSS REFERENCE TO RELATED APPLICATION

This application is based on and incorporates herein by reference Japanese Patent Application No. 2000-113696 filed on Apr. 14, 2000.

BACKGROUND OF THE INVENTION

1. Field of the Invention

The present invention relates to a fuel pump sucking a fuel from a fuel tank and discharging suitable used for internal combustion engine.

2. Description of Related Art

JP-A-6-159282 discloses a fuel pump in which both axial ends of impeller blades incline, with respect to a partition wall, frontwardly in a rotating direction for smoothly introducing fuel into groove spaces formed between each of adjacent impeller blades.

JP-A-6-229388 discloses a fuel pump in which root side of impeller blades incline rearwardly in a rotating direction, and radial outer end of the blades incline frontwardly in the rotating direction. The object of JP-A-6-229388 is to give the fuel flowing out of groove spaces a kinetic energy for flowing frontwardly in the rotating direction, i.e., toward a fuel outlet, without wasting energy of the fuel flowing into the root of groove spaces.

However, in JP-A-6-159282, both axial ends of the blades incline with respect to the partition wall by the same angle from the root to the outer ends. Thus, the energy that the outer end of the blade gives to the fuel flowing out of the groove spaces is small, so that the flow speed of the fuel is insufficiently increased. In JP-A-6-229388, the front face of the impeller blade is formed in a flat in the rotating direction, the fuel hardly flows into the groove space. Thus, fuel amount flowing into the groove space is decreased, thereby reducing total energy given to the fuel. As described above, when fuel flow speed from the groove space is insufficient, or fuel amount flowing into the groove space is small, swirl speed of the fuel is reduced, thereby reducing pump efficiency.

SUMMARY OF THE INVENTION

An object of the present invention is to improve pump efficiency.

According to a first aspect of the present invention, the front face of a blade is formed in a concave shape with respect to a rotating frontward direction. The front face is inwardly concave from both axial ends of the blades, and warps from a root to a radial outer end of the blade to form the concave such that the concave gradually becomes small from the root to the radial outer end. Thus, fuel tends to flow into the root side of the front face, thereby increasing an amount of the fuel flowing into a groove space formed between adjacent blades. The concave of the front face becomes smaller as the radial outer end of the blade, so that the radial outer end of the blade gives the fuel large kinetic energy in the rotating direction from an impeller. Thus, flow speed of the fuel flowing out of the groove space is increased.

According to a second aspect of the present invention, a circumferential width of the groove space gradually decreases from the root to the radial outer end of the blade. Thus, flow speed of the fuel flowing out of the groove space is increased.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS (First Embodiment)

Figure 10:
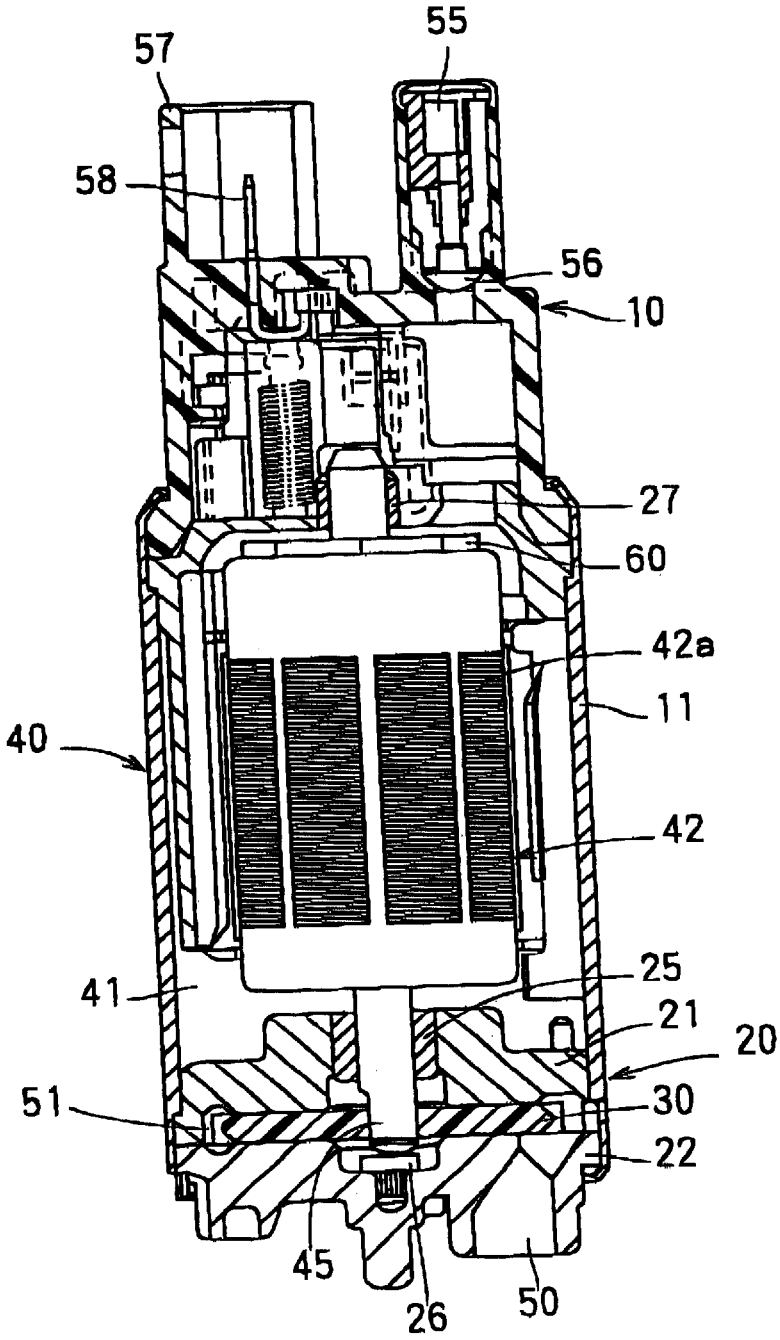
FIG. 10 is a cross-sectional view showing a fuel pump.

FIG. 10 is a cross-sectional view showing a fuel pump 10 in the present embodiment. The fuel pump 10 is used for a fuel supply system in an electronic fuel injection system, and is provided in a vehicle fuel tank. The fuel pump 10 sucks the fuel from the fuel tank and supplies it into an engine.

The fuel pump 10 includes a pump section 20 and a motor section 40 operating the pump section 20. The motor section 40 includes a DC motor having a brush. A permanent magnet is disposed like a ring in a cylindrical housing 11, and an armature 42 is arranged inside the permanent magnet concentrically therewith.

The pump section 20 includes a casing 21, a casing cover 22 and an impeller 30. The casing 21 and the casing cover 22 forms a fluid passage 51 therebetween, and the impeller 30 is rotatably provided in the fluid passage. The casing 21 and the casing cover 22 are made of aluminum die-cast. The casing 21 is press-inserted into the lower end of the housing 11, and a bearing 25 is provided at the center thereof. The casing cover 22 covers the casing 21, and is mechanically fixed to the housing 11. A thrust bearing 26 is press-inserted into the center of the casing cover 22. The bearing 25 radially rotatably supports the lower end of a rotating shaft 45 of the armature 42, and the thrust bearing 26 axially supports the lower end of the rotating shaft 45. A bearing 27 radially rotatably supports the upper end of the rotating shaft 45.

A fuel inlet 50 is formed within the casing cover 22. When the impeller 30 rotates, the fuel in the fuel tank is introduced into the pump fluid passage 51 through the fuel inlet 50. When the impeller 30 rotates, pressure of the fuel introduced into the pump fluid passage 51 is increased. After that, the fuel is discharged into a fuel chamber 41 of the motor section 40 through a fuel outlet formed within the casing 21. A C-shaped pump groove is formed along blades 31 of the impeller 30, in the casing 21. Similarly, a C-shaped pump groove is formed to face the pump groove of the casing 21, in the casing cover 22. Both pump grooves form the pump fluid passage 51.

Figure 1:
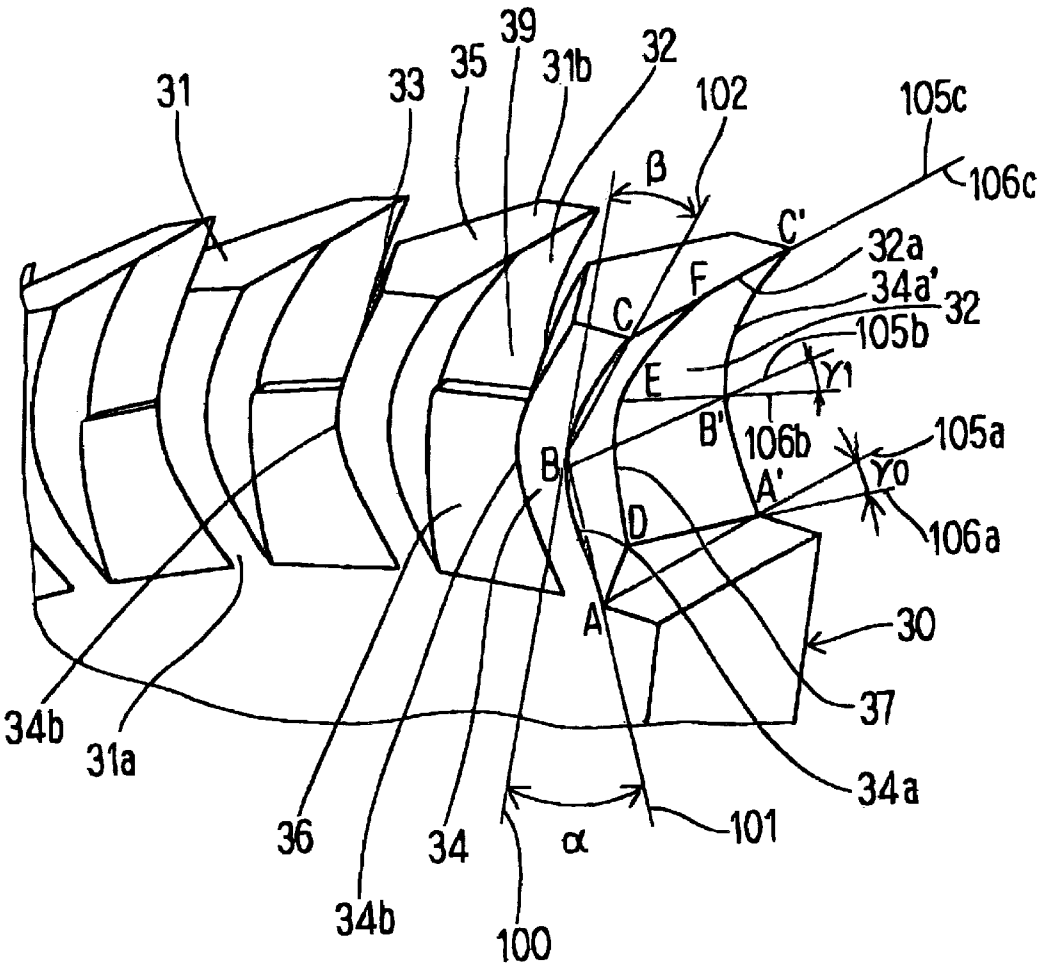
FIG. 1 is a perspective view showing blades of an impeller.
Figure 2:
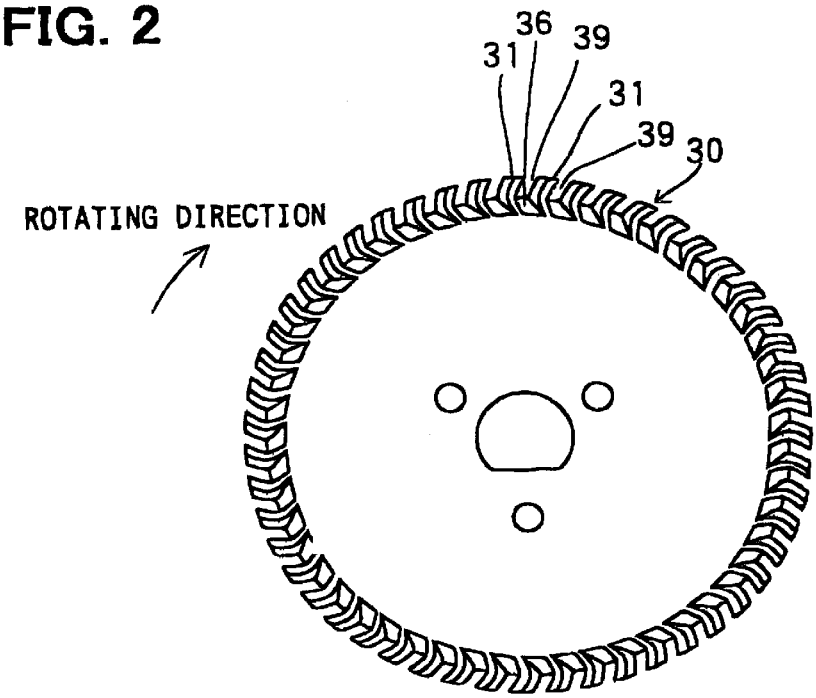
FIG. 2 is a top view showing the impeller.
Figure 4:
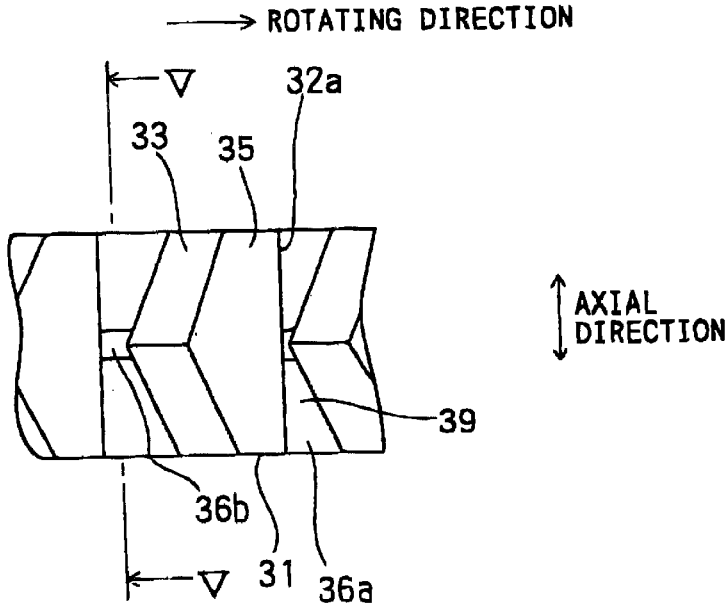
FIG. 4 is a side view showing the impeller, as is viewed from an arrow IV in FIG. 3.
Figure 5:
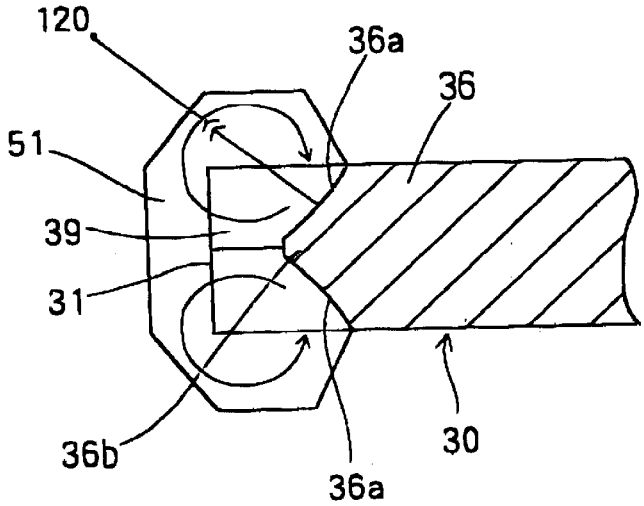
FIG. 5 is a cross-sectional view taken along line V—V in FIG. 4.
Figure 7:
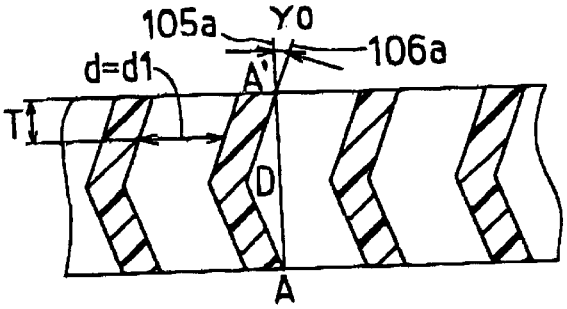
FIG. 7 is a cross-sectional view taken along line VII—VII in FIG. 6.
Figure 8:
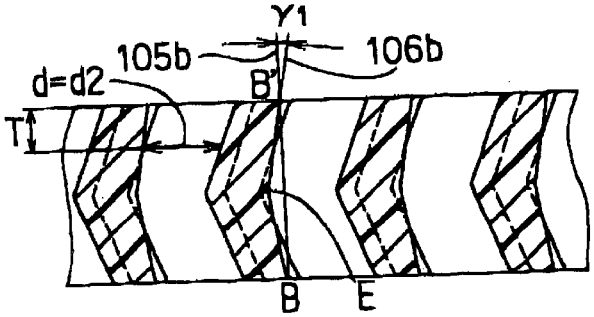
FIG. 8 is a cross-sectional view taken along line VIII—VIII in FIG. 6.
Figure 9:
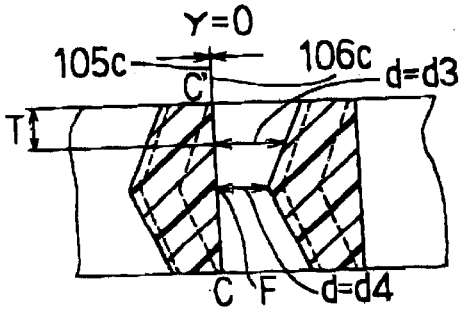
FIG. 9 is a cross-sectional view taken along line IX—IX in FIG. 6.

As shown in FIG. 2, the impeller 30 has a plurality of blades 31 entirely at the outer periphery thereof, and a plurality of groove spaces 39 formed between each of the adjacent blades 31. As shown in FIGS. 1, 4 and 5, a partition wall 36 is provided in the groove space 39. The partition wall 36 is disposed at the center area of the groove space 39 in an axial direction of the impeller 30, and partitions a part of the groove space 39 from a root 31*a* of the blade 31. As shown in FIG. 5, the partition wall 36 includes two wall surfaces 36*a* in the axial direction and a top portion 36*b* therebetween. The wall surface 36*a* is formed in a curved surface whose center 120 is located outside the impeller 30. As shown in FIGS. 7, 8, and 9, circumferential width "d" of the groove space 39 gradually decreases from the root 31*a* to an outer end 31*b* of the blade 31, i.e., gradually decreases radially outwardly. A relationship "d1">"d2">"d3" is shown in FIGS. 7, 8, and 9 at a specific depth "T". Further, as shown in FIG. 9, the circumferential width "d" of the groove space 39 gradually decreases from both axial ends to the axial center of the impeller 30, i.e., gradually decreases axially inwardly. A relationship "d3">"d4" is shown in FIG. 9.

Figure 3:
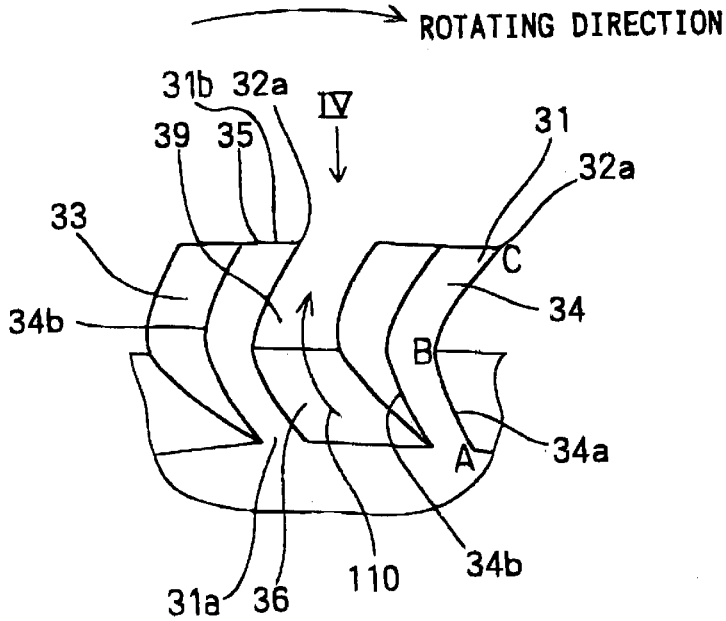
FIG. 3 is an enlarged top view showing the impeller.

As shown in FIG. 3, the blade 31 inclines backwardly in the rotating direction at the root 31*a* side, and inclines frontwardly in the rotating direction at the outer front edge 32*a* side. Further, as shown in FIG. 4, the blade 31 inclines frontwardly in the rotating direction from the axial center to both axial ends symmetrically with respect to the partition wall 36. As shown in FIGS., 1 and 3, the blade 31 defines a front face 32, a rear face 33, side faces 34 located at both axial ends, and a radially outer end face 35. The front face 32, which is positioned at the front side of the blade 31 in the rotating direction, is formed in a concave with respect to the rotating frontward direction. The front face 32 warps from the root 31*a* to the outer end 31*b* to form the concave such that the concave gradually becomes small from the root 31*a* to the outer end 31*b*. Further, the front face 32 is inwardly concaved from both axial ends. The outer front edge 32*a* of the front face 32, i.e., the front edge of the outer end face 35, is formed in a linear line. A bottom line 37 of the concave of the front face 32 is located at the axial center of the blade 31. The rear face 33, which is positioned at the rear side of the blade 31 in the rotating direction, is formed in a convex with respect to the rotating rear direction.

Front edge 34*a* and rear edge 34*b* of the side face 34 are curved backwardly in the rotating direction. In the present embodiment, curvatures of the front edge 34*a* at the root 31*a* side and outer end 31*b* side thereof are approximately equal, and curvatures of the rear edge 34*b* at the root 31*a* and outer end 31*b* side thereof are also approximately equal. The curvatures may be different from each other in accordance with a required performance of the fuel pump. Further, in the present embodiment, curvatures of the front edge 34*a* and the rear edge 34*b* are equal. Alternatively, the curvatures may be different from each other.

A virtual linear line 101 passes through a root point "A" of the front edge 34*a* and a concave bottom point "B" of the front edge 34*a*. A virtual linear line 100 passes through the center of the impeller 30 and the bottom point "B". The virtual linear lines 100 and 101 define an inclination angle $\alpha$. A virtual linear line 102 passes through an outer end point "C" of the front edge 34*a* and the concave bottom point "B" of the front edge 34*a*. The virtual linear lines 100 and 102 define an inclination angle $\beta$. A virtual linear line 105*a* passes through the root points "A" and "A'" of both front edges 34*a* and 34*a'* in the axial direction. A virtual linear line 106*a* passes through the root point "A'" and a root point "D" of the bottom line 37. The virtual lines 105*a* and 106*a* define an inclination angle $\gamma_0$. In the present embodiment, the inclination angles $\alpha$, $\beta$, $\gamma_0$ are set as follows:

$$0° \leqq \alpha \leqq 45°$$

$$0° \leqq \beta \leqq 45°$$

$$\alpha \approx \beta$$

$$10° \leqq \gamma_0 \leqq 45°$$

The shape of the front face 32 will be explained in more detail with reference to FIGS. 1, 6–9 and 13A.

Figure 6:
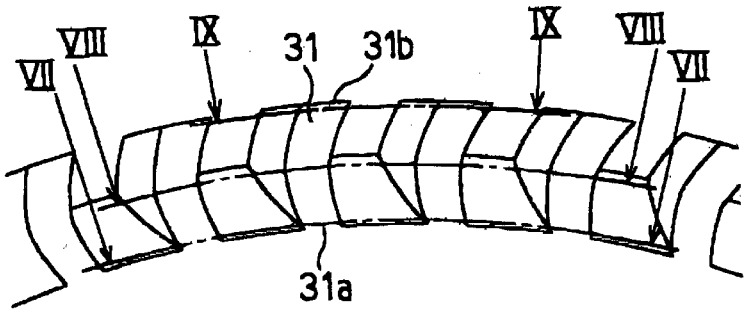
FIG. 6 is an enlarged view showing the impeller for explaining the shape of a front face of the blades.

As described above, the front face 32 warps from the root 31*a* to the outer end 31*b* thereof to form the concave such that the concave gradually becomes small from the root 31*a* to the outer end 31*b*. As shown in FIGS. 6 and 7, at the most root 31*a* side, the virtual linear line 105*a* passes through the root points A and A', and the virtual linear line 106*a* passes through the root point A' and the root point D. The inclination angle $\gamma$ defined by the virtual lines 105*a* and 106*a* is $\gamma_0$.

As shown in FIGS. 6 and 8, at the intermediate area of the blade 31, a virtual linear line 105*b* passes through the concave bottom points B and B', and a virtual linear line 106*b* passes through the concave bottom point E and the root points B'. The virtual linear line 105*b* is in parallel with the virtual linear line 105*a*. The inclination angle $\gamma$ defined by the virtual lines 105*b* and 106*b* is $\gamma_1$ which is smaller than $\gamma_0$. The concave bottom points B and B' are located at back side more than the root points A and A' in the rotating direction.

As shown in FIGS. 6 and 9, at the outer end area of the blade 31, a virtual linear line 105*c* passes through outer end edge points C and C', and a virtual linear line 106*c* passes through a concave bottom point F and the outer end edge point C'. Here, the virtual linear lines 105*c*, 106*c* are on the outer front edge 32*a* and in parallel with the virtual linear line 105*a*. Thus, the inclination angle $\gamma$ defined by the virtual lines 105*c* and 106*c* is 0 (degree).

Figure 13A:
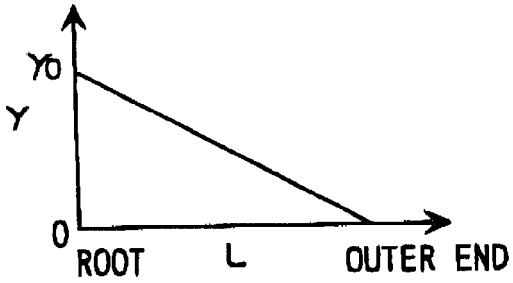
FIG. 13A is a graph showing a relation between a distance "L" from a root to an outer end of the blade and inclination angle "γ"

As described above, the inclination angle $\gamma$ decreases from the root 31*a* to the outer end 31*b*. In the present embodiment, as shown in FIG. 13A, the inclination angle $\gamma$ linearly decreases from $\gamma_0$ to 0. In this way, the front face 23 warps from the root 31*a* to the outer end 31*b* to form the concave.

As shown in FIG. 10, the armature 42 is rotatably provided in the motor section 40, and a coil is wound around a core 42*a*. A rectifier 60 is formed in a disc, and is provided above the armature 42. An electric current is supplied to the coil through a terminal 58 built in a connector 57, a brush (not illustrated), and the rectifier 60. When the armature 42 rotates due to the electric current, the rotating shaft 45 and the impeller 30 rotate together. When the impeller 30 rotates, the fuel is introduced into the pump fluid passage 51 through the fuel inlet 50. The fuel receives kinetic energy from each blade 31, passes through the pump fluid passage 51 and the fuel outlet, and is discharged into a fuel chamber 41. After that, the fuel passes around the armature 42, and is discharged out of the fuel pump through a discharge port 55. A check valve 56 is provided in the discharge port 55, and prevents flow-back of the fuel discharged through the discharge port 55.

Next, an operation of the impeller 30 increasing a fuel pressure will be explained.

In FIG. 3, as denoted by an arrow 110, the fuel in the pump fluid passage 51 flows into the groove space 39 from the root 31*a* side of the blade 31 due to a rotation of the impeller 30. Since the front face 32 is formed in a concave and the concave is large at the root 31*a* side thereof, the fuel tends to flow into the root 31*a* side of the front face 32, thereby increasing an amount of the fuel flowing into the groove space 39. The fuel introduced into the groove space 39 is guided along the front face 32 and the wall surfaces 36*a* of the partition wall 36, and from the root 31*a* to the intermediate area. Here, since the circumferential width "d" of the groove space 39 inwardly decreases from both axial ends, flow speed of the fuel in the groove space 39 gradually increases as the fuel flows toward the partition wall 36.

The radially outer part of the front face 32 frontwardly inclines in the rotating direction, so that the fuel having passed through the intermediate area and flowing radially outwardly in the groove space 39 is guided by the front face 32 and given a kinetic energy for flowing frontwardly in the rotating direction. Further, since the width "d" decreases from the root 31*a* to the outer end 31*b* and the groove space 39 is restricted, flow speed of the fuel flowing out of the groove space 39 is increased. As shown in FIG. 5, the fuel flowing out of the groove space 39 is guided by curved wall surface 36*a* of the partition wall 36 and a wall of the pump fluid passage 51 to swirl thereinside, and flows into the root 31*a* side of next groove space 39 located at the rear side of the current groove space 39 in the rotating direction.

In this way, the fuel flows toward the fuel outlet while swirling in the pump fluid passage 51 and flowing into and out of the groove spaces 39 orderly. As a result, pressure of the fuel is increased.

According to the above-described embodiment, as shown in FIG. 13A, the concave of the front face 32 continuously becomes small from the root 31*a* to the outer end 31*b*. That is, the inclination angle $\gamma$ linearly decreases from $\gamma 0$ to 0 (zero). In FIG. 13A, "L" indicates a distance from the root 31*a* to the outer end 31*b*.

Alternatively, a front face may be concaved differently from the above-described embodiment. A first modification is shown in FIGS. 11 and 13B, and a second modification is shown in FIGS. 12 and 13C.

Figure 11:
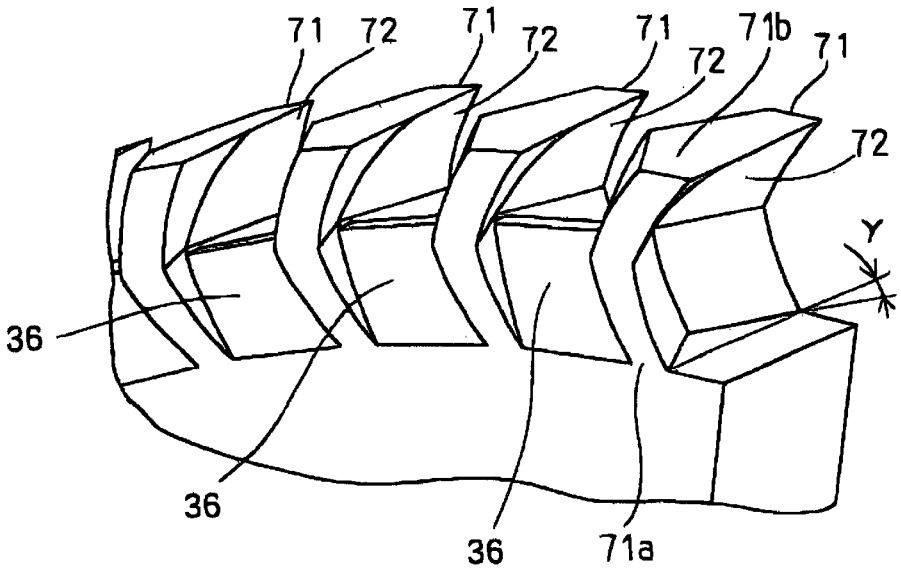
FIG. 11 is a perspective view showing blades of an impeller (first modification)
Figure 13B:
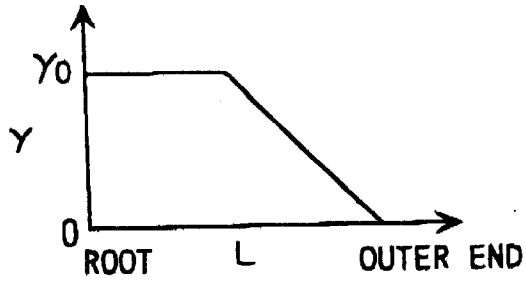
FIG. 13B is a graph showing a relation between a distance "L" from a root to an outer end of the blade and inclination angle "γ" (first modification)

In the first modification, as shown in FIGS. 11 and 13B, concave of the front face 72 of blade 71 is constant from the root 71*a* to the intermediate part, and gradually becomes small from the intermediate part to the outer end 71*b*.

Figure 12:
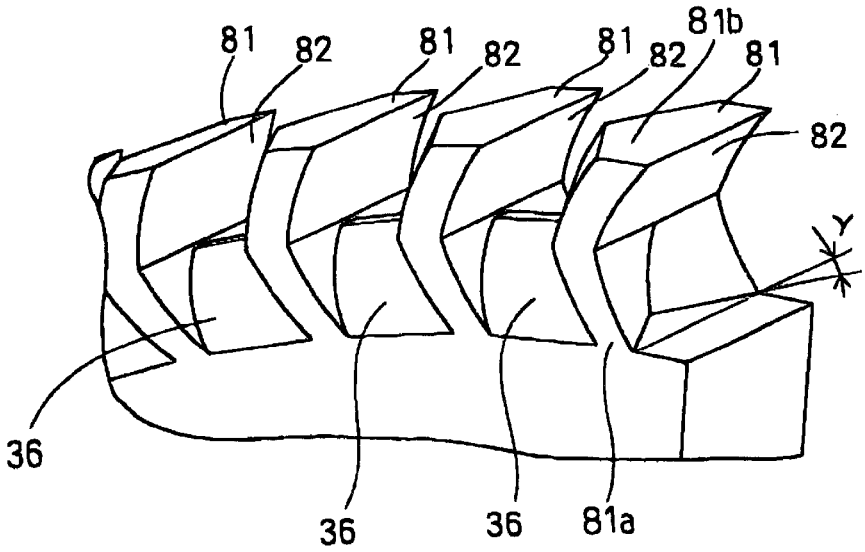
FIG. 12 is a perspective view showing blades of an impeller (second modification)
Figure 13C:
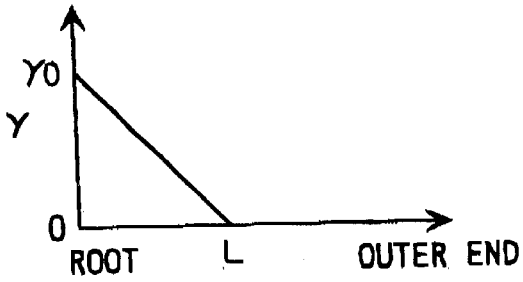
FIG. 13C is a graph showing a relation between a distance "L" from a root to an outer end of the blade and inclination angle "γ" (second modification).

In the second modification, as shown in FIGS. 12 and 13C, concave of the front face 82 of the blade 81 sharply becomes small from the root 81*a* to the intermediate part, and the concave ends at the intermediate part. The inclination angle $\gamma$ is constantly 0 (degree) from the intermediate part to the outer end 81*b*.

According to the above described embodiment and modifications thereof, the front face 32 of the blade 31 is formed in a concave, and the concave gradually becomes small from the root 31*a* to the outer end 31*b*, so that the fuel tends to and easily flow into the groove space 39. Further, the root 31*a* side front face 32 inclines rearwardly in the rotating direction, so that the fuel flowing into the groove space 39 diagonally collides with the front face 32. Thus, energy reduction of the fuel introduced into the groove space 39 is suppressed.

The concave of the front face 32 becomes smaller as the outer end 31*b* of the blade 31, so that the outer end 31*b* of the blade 31 gives the fuel large kinetic energy in the rotating direction from the impeller 30. Thus, flow speed of the fuel flowing out of the groove space 39 is increased. Further, at the outer end 31*b* area, the front face 32 inclines frontwardly in the rotating direction, so that kinetic energy is given to the fuel for flowing frontwardly in the rotating direction.

In the above-described embodiment and modifications, the concave of the front face continuously becomes small from the root to the outer end. Alternatively, the concave of the front face may become small in step-wise, for example.

The impeller 30 may have a ring at the outer periphery thereof. In this case, the fuel from the front face collides with the ring, and changes the flow direction thereof perpendicularly, to flow into the pump fluid passage 51.

What is claimed is:

1. A fuel pump comprising:

an impeller having a plurality of blades at an outer periphery thereof, each of the adjacent blades defining a groove space;

a partition wall provided in the groove space, for partitioning the groove space from a root of said blade; and a casing rotatably containing said impeller therein, said casing including an arc-shaped pump fluid passage along said blades, said casing including a fuel inlet and a fuel outlet communicating with said pump fluid passage, wherein said impeller rotates to introduce fuel into said pump fluid passage through said fuel inlet and discharge the fuel through said fuel outlet, said blade defines a front face positioned at a front side of said blade in a rotating direction of said impeller, the front face is formed in a concave with respect to a rotating frontward direction, the front face is inwardly concaved from both axial ends, and warps from the root of said blade to a radial outer end thereof to form the concave such that the concave gradually becomes smaller from the root to the radial outer end.

2. A fuel pump according to claim 1, wherein the front face is concaved such that the concave continuously becomes smaller from the root to the radial outer end, and a radial outer front edge of the front face is formed in a linear line.

3. A fuel pump according to claim 1, wherein the front face is concaved to define a bottom line thereof, and the bottom line is located at a center of said blade in the axial direction of said impeller.

4. A fuel pump according to claim 3, wherein said blade defines side faces positioned at both axial ends thereof, a front edge of the side face is curved backwardly in the rotating direction, a first virtual linear line passes through a root point of the front edge and a curved bottom point of the front edge, a second virtual linear line passes through a center of said impeller and the curved bottom point, the first virtual linear line and the second virtual linear line define an inclination angle $\alpha$, a third virtual linear line passes through an outer end point of the front edge and the curved bottom point of the front edge, the second virtual linear line and the third virtual linear line define an inclination angle $\beta$, a fourth virtual linear line passes through the root points of both front edges in the axial direction, a fifth virtual linear line passes through the root point of the front edge and a root point of the bottom line, the fourth virtual linear line and the fifth virtual linear line define an inclination angle $\gamma_0$, and the inclination angles $\alpha$, $\beta$, $\gamma_0$ are set as follows:

$$0° \leqq \alpha \leqq 45°$$

$$0° \leqq \beta \leqq 45°$$

$$\alpha \approx \beta$$

$$10° \leqq \gamma_0 \leqq 45°.$$

5. A fuel pump according to claim 1, wherein said blade inclines backwardly in the rotating direction at the root side thereof, and inclines frontwardly in the rotating direction at the radial outer end side thereof.

6. A fuel pump according to claim 5, wherein said blade defines side faces positioned at both axial ends thereof, a front edge and a rear edge of the side face are curved backwardly in the rotating direction, curvatures of the front edge at the root side and the radial outer end side thereof are approximately equal, and curvatures of the rear edge at the root side and the radial outer end side thereof are approximately equal.

7. A fuel pump according to claim 5, wherein said blade defines side faces positioned at both axial ends thereof, a front edge and a rear edge of the side face are curved backwardly in the rotating direction, curvatures of the front edge and the rear edge are approximately equal to each other.

8. A fuel pump according to claim 1, wherein wall surface of said partition wall is formed in a curved surface.

9. A fuel pump comprising:

an impeller having a plurality of blades at an outer periphery thereof, each of the adjacent blades defining a groove space;

a partition wall provided in the groove space, for partitioning the groove space from a root of said blade; and a casing rotatably containing said impeller therein, said casing including an arc-shaped pump fluid passage along said blades, said casing including a fuel inlet and a fuel outlet communicating with said pump fluid passage, wherein said impeller rotates to introduce fuel into said pump fluid passage through said fuel inlet and discharge the fuel through said fuel outlet, a circumferential width of the groove space gradually decreases from the root to a radial outer end of said blade.

10. A fuel pump according to claim 9, wherein the circumferential width of the groove space gradually decreases from both axial ends to an axial center of said blade.

11. The fuel pump according to claim 1, wherein the partition wall is disposed at a center area of the groove space in an axial direction of said impeller.

12. The fuel pump according to claim 1, wherein the concave of the front face continuously becomes smaller from the root to the radial outer end.

13. The fuel pump according to claim 1, wherein the blade has a rear face that is formed in a convex.

14. The fuel pump according to claim 1, wherein the concave of the front face is defined with tapered lines with respect to an axial direction of the impeller.

15. The fuel pump according to claim 1, wherein the groove space defines a circumferential width that is gradually decreased from the root to a radial outer end of said blade.

16. The fuel pump according to claim 9, wherein the partition wall is disposed at a center area of the groove space in an axial direction of said impeller.

17. A fuel pump comprising:

an impeller having a plurality of blades which defines a plurality of grooves circumferentially arranged on the impeller, the grooves being opened toward an axial direction; and a casing rotatably containing the impeller therein, said casing defining an arc-shaped pump fluid passage along the circumferentially arranged grooves, a fuel inlet communicating with the pump fluid passage and a fuel outlet communicating with the pump fluid passage, wherein each of the blades has a front face having a radial outer area and a radial inner area which is closer to a root of the blade than the radial outer area, the radial inner area being inclined with respect to an axial direction of the impeller, the radial inner area being inclined backwardly in a rotational direction from an axial end of the blade, and the radial inner area being more backwardly inclined relative to the radial outer area.

18. The fuel pump according to claim 17, wherein the inclination angle of the front face with respect to the axial direction is gradually decreased from the radial inner area to the radial outer area.

19. The fuel pump according to claim 17, wherein a circumferential width (d2) of the groove on an axially intermediate and radially intermediate position of the blade is greater than a circumferential width (d3) of the groove on an axially intermediate and radially outer position of the blade.

20. The fuel pump according to claim 17, wherein the radial inner area of the blade defines a radial inner part of the groove, and the radial outer area of the blade defines a radial outer part of the groove, and wherein the radial outer part of the groove is widened toward an axial end opening of the groove.

* * * * *

UNITED STATES PATENT AND TRADEMARK OFFICE

CERTIFICATE OF CORRECTION

PATENT NO. : 6,497,552 B2
DATED : December 24, 2002
INVENTOR(S) : Kobayashi et al.

It is certified that error appears in the above-identified patent and that said Letters Patent is hereby corrected as shown below:

Title page,
Item [73], Assignee, please change "Sharp Kabushiki Kaisha, Osaka (JP)" to -- Denso Corporation, Aichi-Pref. (JP) --.

Signed and Sealed this

Thirtieth Day of August, 2005

JON W. DUDAS
*Director of the United States Patent and Trademark Office*